US006176670B1

(12) United States Patent
Salsburg

(10) Patent No.: US 6,176,670 B1
(45) Date of Patent: Jan. 23, 2001

(54) ROLL HANDLING AND TRANSPORT ASSEMBLAGE

(75) Inventor: Fredric S. Salsburg, Victor, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/295,207

(22) Filed: Apr. 21, 1999

(51) Int. Cl.[7] ..... B21C 47/24

(52) U.S. Cl. ..... 414/391; 242/559.4; 242/563; 414/911

(58) Field of Search ..... 242/559.4, 563; 414/911, 391; 187/237, 401, 269

(56) References Cited

U.S. PATENT DOCUMENTS

| | | | | |
|---|---|---|---|---|
| 4,913,367 | * | 4/1990 | Hata | 242/563 |
| 5,308,217 | * | 5/1994 | Pienta | 414/610 |
| 5,494,269 | * | 2/1996 | McCalmont | 269/224 |

FOREIGN PATENT DOCUMENTS

| | | | | |
|---|---|---|---|---|
| 214393 | * | 4/1961 | (AT) | 424/559.4 |
| 1940426 | * | 3/1970 | (DE) | 242/559.4 |
| 697359 | * | 8/1995 | (EP) | 242/563 |
| 4643973 | * | 8/1968 | (JP) | 414/911 |
| 51-1226 | * | 1/1976 | (JP) | 242/559.4 |
| 52-73274 | * | 6/1977 | (JP) | 424/559.4 |
| 56-70251 | * | 6/1981 | (JP) | 242/559.4 |
| 57-120612 | * | 7/1982 | (JP) . | |
| 58-122119 | * | 7/1983 | (JP) | 242/559.4 |
| 3-77719 | * | 4/1991 | (JP) | 242/559.4 |
| 5-23741 | * | 2/1993 | (JP) | 242/563 |
| 523740 | * | 2/1993 | (JP) | 242/563 |

* cited by examiner

*Primary Examiner*—Steven A. Bratlie
(74) *Attorney, Agent, or Firm*—Clyde E. Bailey, Sr.

(57) ABSTRACT

An assemblage for aligning a roll to a chucking device has at least two flexibly movable, spaced roll support members arranged planarily for supporting the roll for alignment with a fixed positioned chucking device. Each roll support member has a compression head biased for movement by a plurality of cooperating spring members. Precise alignment of the core with the chucking device results from the force imparted to the flexibly movable support member bearing the roll by the chucking device engaging the core.

5 Claims, 4 Drawing Sheets

ROLL HANDLING AND TRANSPORT ASSEMBLAGE

CROSS-REFERENCE TO RELATED APPLICATIONS

The present application is related to U.S. Application Ser. No. 09/295,217, filed Apr. 21, 1999, by Fredric S. Salsburg, and entitled, "Flexible Roll Chucking Assemblage and Method."

FIELD OF THE INVENTION

The invention relates generally to the field of materials handling devices. More specifically, the invention concerns a reliable assemblage and method for aligning a wound roll of web for engagement by cooperating equipment without damaging the roll during the handling process.

BACKGROUND OF THE INVENTION

A variety of devices exist for handling large rolls of wound web, such as rolls of photosensitive paper and film, during web manufacturing operations. For photosensitive roll products, this operation is generally conducted in the absence of light. With the advent of worldwide supply chains, the core used, even on large rolls of wound web, is normally a paperboard tube. These paperboard tubes are expendable at the end user site, so there is no need for a return system. While the economics of this type of core are generally favorable, the core, nonetheless, presents problems. Significantly, experience indicates that the paperboard cores of the rolls of wound web can be quite easily damaged if the chucks that engage them for handling and transport arc not precisely centered in core openings.

A typical example of this type of roll handling situation arises where the roll is unwound, by for instance winder/unwinder equipment, such as described in U.S. Pat. No. 5,308,217, issued May 3, 1994, by Pienta, and entitled, "Roll Chucking Apparatus," and then exposed to further independent treatment. Experience indicates that it is more practical to handle rolls of web on the outer surface as opposed to a center core. In order to unwind the roll of web with even tension control, however, the roll is best supported by the core of the roll. The core of the roll is supported by the core openings on opposing ends of the roll.

Engagement of chucks or pins into core openings of the core using some sort of circumferential surface support device has always been a problem because the outer diameters of the cores are not the same from roll to roll, or even from side to side on one roll. Additionally, there is winding side shift and equipment positioning tolerances to account for. Moreover, the exact location of the core openings is quite variable.

As the chucking device enters the hollow core openings, the inner layers of paperboard can shear off and cause binding as they rotate or fold about the core. Furthermore, the paperboard can wedge between the inner wall of the core and chucking device. This happens even when the chucking device has smoothly tapered or round edges for entering the core of rolls that can weigh in the thousands of pounds.

An existing practice for aligning a roll with a chucking device is to first introduce the roll to a pre-alignment station in a well-lighted environment prior to the intended alignment. In this case, the roll is aligned with pseudo-chucks that are located in the same relative position as the real intended machine chucks. This usually involves an operator visually inspecting each side of the roll, and determining which way to incrementally move the roll, until both of the pseudo chucks can be freely inserted into the core. Generally the roll has a core end that is typically cone-shaped, and not positioned perpendicular to the machine centerline. This requires the roll to be manuvered into several planes. The roll is then moved into the intended chucking position without disturbing the roll attitude, other than a horizontal translation from the pre-alignment position to the operating position. At that point, the roll is chucked into engagement, using full power equipment usually on a large turret, in process conditions (which may well be dark) and within range of other powerful and dangerous automatic start and splice equipment. It is normal manufacturing practice to splice the tail of one roll to the start of the next, for continuous web supply to the downstream processing systems. This presents a confined and dangerous situation for an operator to see how to jog the roll into alignment, hence the pre-alignment station.

Conventional equipment for transporting the roll of web to a chucking station uses multiple powered drives that can rotate, tip, side-shift, raise-lower, and move forward-reverse in order to provide the flexible motion needed to position the roll accurately. It is well known that this practice is quite expensive, slow, space consuming, and, depending on the operator accuracy, generally unreliable.

Another problem with existing devices for handling rolls of web for chucking arises when the chuck device is withdrawn from the core openings of the roll core and damage results to the core. This can occur even if the chucks complete their full engagement stroke. The onset of this problem may arise if the core is slightly damaged sufficient enough to cause severe wedging of paper inside the core. The chucks can be very difficult to remove in this case and sometimes their failure to cleanly withdraw from the core may cause a complete shutdown of the whole operation. When this occurs, skilled operators are required to disengage the chuck from the core.

Yet another problem with presently available devices for handling a roll of web prior to chucking is that there exists no known feasible way to provide the space required for a pre-alignment station, discussed above.

Moreover, skilled artisans will appreciate that the alignment of large rolls has several interrelated motions, where time, space, cost, and complexity all have boundaries that prevent simply adding all the equipment required to provide for all necessary controlled motions.

It is well known in the prior art to use load cells on a lift that is supporting the roll, to detect if the chucks were pushing up or down too hard on the core. A major shortcoming of this approach, however, is that there is no recognition of horizontal forces, axial forces, or combinations of opposing vertical forces. This may occur where there is force applied by the chuck on one end of the core that forces the core upwardly; and, simultaneously, a force is applied to the opposing end of the core that forces the core downwardly. The load cell may detect a zero sum change although both ends of the core may have been damaged as a result of the forces.

Removing a roll from the chucks has also been a problem where the roll is somewhat cone-shaped. Traditionally, if the roll is even slightly cone-shaped and the lift fixed in a horizontal plane for simplicity, it is almost impossible to unload the weight from the chucks evenly, which must be accomplished if the chucks are to be retracted without damage to the core.

Notwithstanding the aforementioned problems in the art, there has been some success partially aligning a roll of web with respect to a mounting position of a chucking device. For instance, in U.S. Pat. No. 5,192,033, titled "Apparatus for Moving Rolls From a Loading Station to an Unwinding Station and for Moving Empty Roll Cores From the Unwinding Station to the Loading Station," to Pipes, an apparatus is disclosed for moving rolls from a loading station to an unwinding station and for moving empty roll cores from the unwinding station to the loading station. Pipes provides for separate lifts positioned on each end of the core, which correct for a taper wound roll, but uses the core to measure with. Further, U.S. Pat. No. 5,308,217 discloses a roll chucking apparatus that operates based on forces being applied to the roll being transported and is capable of only a vertical corrective positioning of the roll.

However, both of the aforementioned prior art patents only provide for vertical positioning capability of the roll to be chucked relative to the chuck position. These prior art teachings, therefore, each fail to provide flexible, multi-directional, orienting, and aligning movements of the roll of web to a chuck.

Therefore, a need persists in the art for an apparatus for handling rolls of web that can provide flexible vertical and translational movements for precise docking with a chuck device. Moreover a need persists for a system for transferring a wound roll of web from an exterior surface support station, to a center core support element of independent, cooperating equipment, and back to the surface support as required by the manufacturing system without producing any damage to the roll.

SUMMARY OF THE INVENTION

It is, therefore, an object of the invention to provide a flexible roll chucking assemblage that enables precise alignment of a roll with a chucking device.

It is another object of the invention to provide a flexible roll chucking assemblage that enables the core openings of a roll to flexibly align with chucking elements having a fixed orientation.

Yet another object of the invention is to provide a flexible roll chucking assemblage for aligning a roll to a chucking device that produces minimum force when the roll contacts the chucking device.

It is a feature of the invention that a flexible roll chucking assemblage and method for precisely aligning a roll to a chuck includes a flexibly mounted platform for supporting the roll for alignment with opposed engagement members of the chucking device.

To accomplish these and other objects and features of the invention, there is provided, in one aspect of the invention, a roll handling and transport assemblage, comprising:

means for retrieving the roll from a first roll storage and then moving said roll to a flexibly, movable roll support member, said flexible movable roll support member comprising a plurality of spaced biased compression heads, each of said compression heads comprises a plurality of springs biased between a top cover and said frame for flexibly supporting said roll;

a first sensor for sensing the elevation of the roll on the first roll storage, said sensor producing a first signal corresponding to said elevation;

means for moving said movable roll support member to a second roll storage having a fixed centerline, said second roll storage having a preferred orientation for receiving said roll;

a second sensor for sensing said fixed centerline of said second roll storage, said second sensor generating a second signal corresponding to said fixed centerline of said second storage; and, means for comparing said first signal to said second signal such that any difference between said first and second signals causes said support member to movably align relative to said fixed centerline of said second storage.

The assemblage of the invention provides numerous advantages over the prior art. More particularly, the invention provides a simple and reliable means of aligning the core of a roll to the chucking device of winder or unwinder equipment. Importantly, the apparatus of the invention functions despite physical variables, such as, the roll wound cone-shaped, off-center wind, chuck positioning errors, variation in roll positioning, and a wide range of roll diameters.

Furthermore, the roll chucking assemblage of the invention has the advantage of enabling totally automatic roll handling in a completely dark environment. This advantage enables the operator to work remotely and out of harms way.

Still further, the roll chucking assemblage of the invention applies minimum force to the pressure sensitive roll of web product, dramatically reducing roll telescoping and virtually eliminating core damage. This is because, in applicant's invention, the roll of web is "floating" so it will come into exact alignment without high forces involved.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 2:
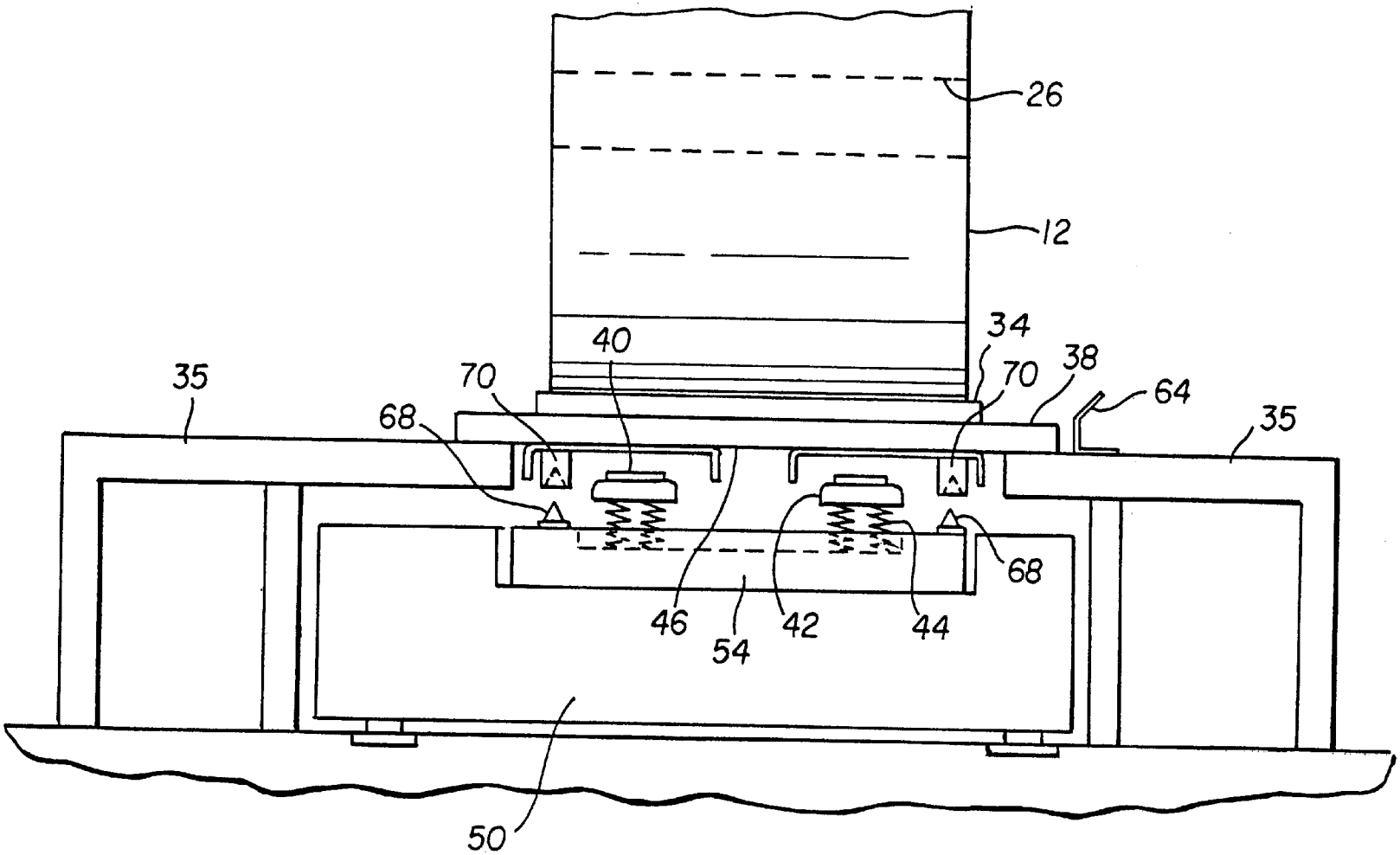
FIG. 2 is a section view along the II—II line of FIG. 1 showing the transfer stand supports the pallet and provides access for the shuttle car under the pallet.
Figure 3:
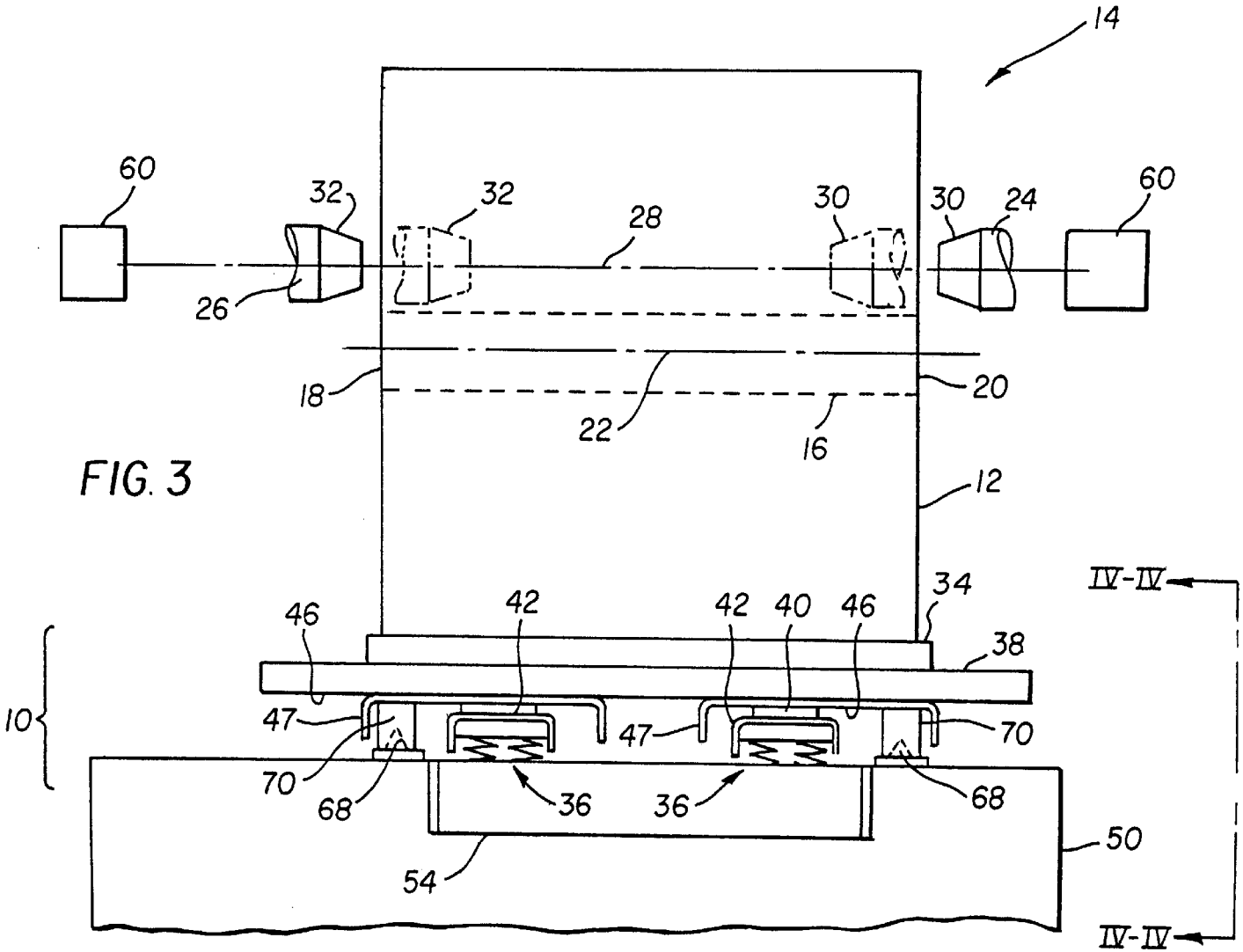
FIG. 3 is a section view along the III—III line of FIG. 1 showing a portion of the shuttle car, the travel position of the pallet on the alignment cones and the relative elevation position of the chucking device.
Figure 4:
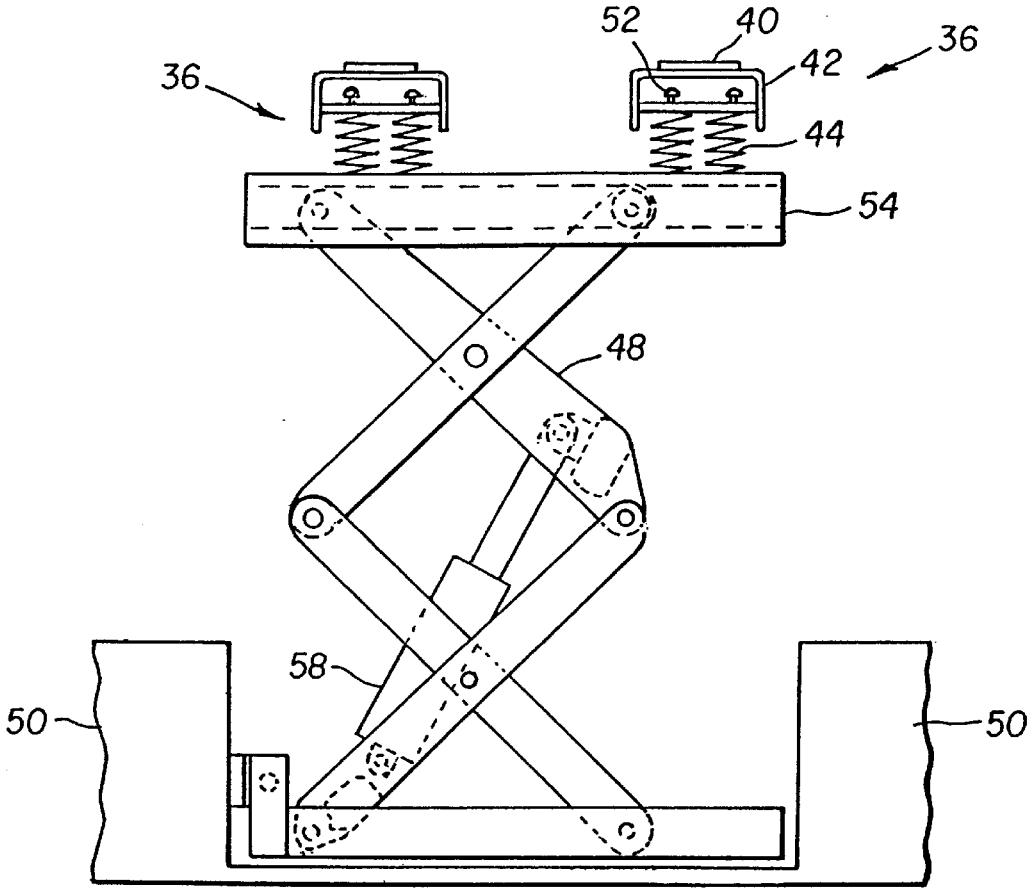
FIG. 4 is a section view along line IV—IV of FIG. 3 showing the lift with an expanded view of the preferred embodiment on the lift platform and load cell mounted underneath the lift.
Figure 5:
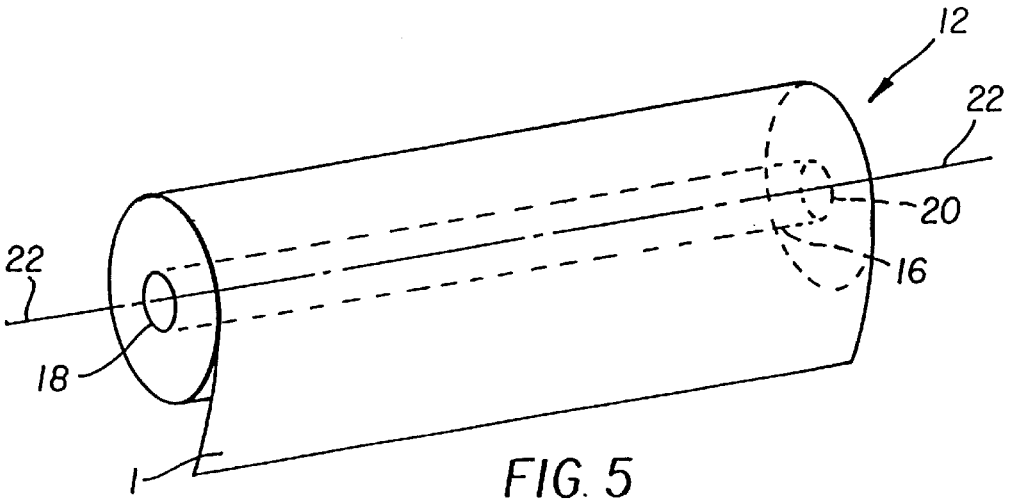
FIG. 5 (Prior Art)
FIG. 5 is a front elevated view of a typical roll of web handled by the assemblage of the invention.

Turning now to the drawings, and in particular to FIGS. 2–4, roll chucking assemblage 10 for aligning a roll 12 having web 1 thereon to a chucking device 14 according to the principles of the invention is illustrated. Assemblage 10 provides "free floating" alignment of roll 12 relative to the chucking device 14. As illustrated in FIG. 5, roll 12, having a predetermined diameter, has a core 16 with core openings 18, 20 in opposite ends of the core 16. Core openings 18, 20 receive chucking device 14 (described below) that rotatably engage and support the roll 12 for winding or unwinding web 1 thereon. For purposes that will become more obvious below, core openings 18, 20 configured in opposite ends of core 16 has a first centerline 22 passing therebetween.

Referring to FIG. 3, chucking device 14, defining a pair of core engagement members or support pins 24, 26 engage an aligned core opening 18, 20. Each core engagement member 24, 26 has a nose portion 30, 32, respectively, for facilitating engagement with core openings 18, 20. Further, opposing core engagement members 24, 26 of chucking device 14 are arranged along a second centerline 28 passing therebetween which ultimately must align with first centerline 22 passing between core openings 18, 20.

Referring to FIGS. 1–4, assemblage 10 of the invention has utility in a manual mode and in a fully automatic roll removal mode. Skilled artisans will appreciate that fully automatic roll removal would be preferred where the product or roll 12 is light sensitive material requiring maneuvering in a dark environment. In the dark environment, an operator would not have the ability to make corrections to either the chucking device 14 or roll being removed or mounted on each end of the chucking device 14 because of the absence of light. Thus, it will be appreciated that the compliance capability of assemblage 10 of the invention dramatically improves weight transfer of roll 12 from chucking device 14. Also, it is contemplated that roll 12 is unloaded onto some sort of lift device (described below) arranged beneath the roll 12, to remove roll 12 from the chucking position relative to the chuck device 14.

Figure 1:
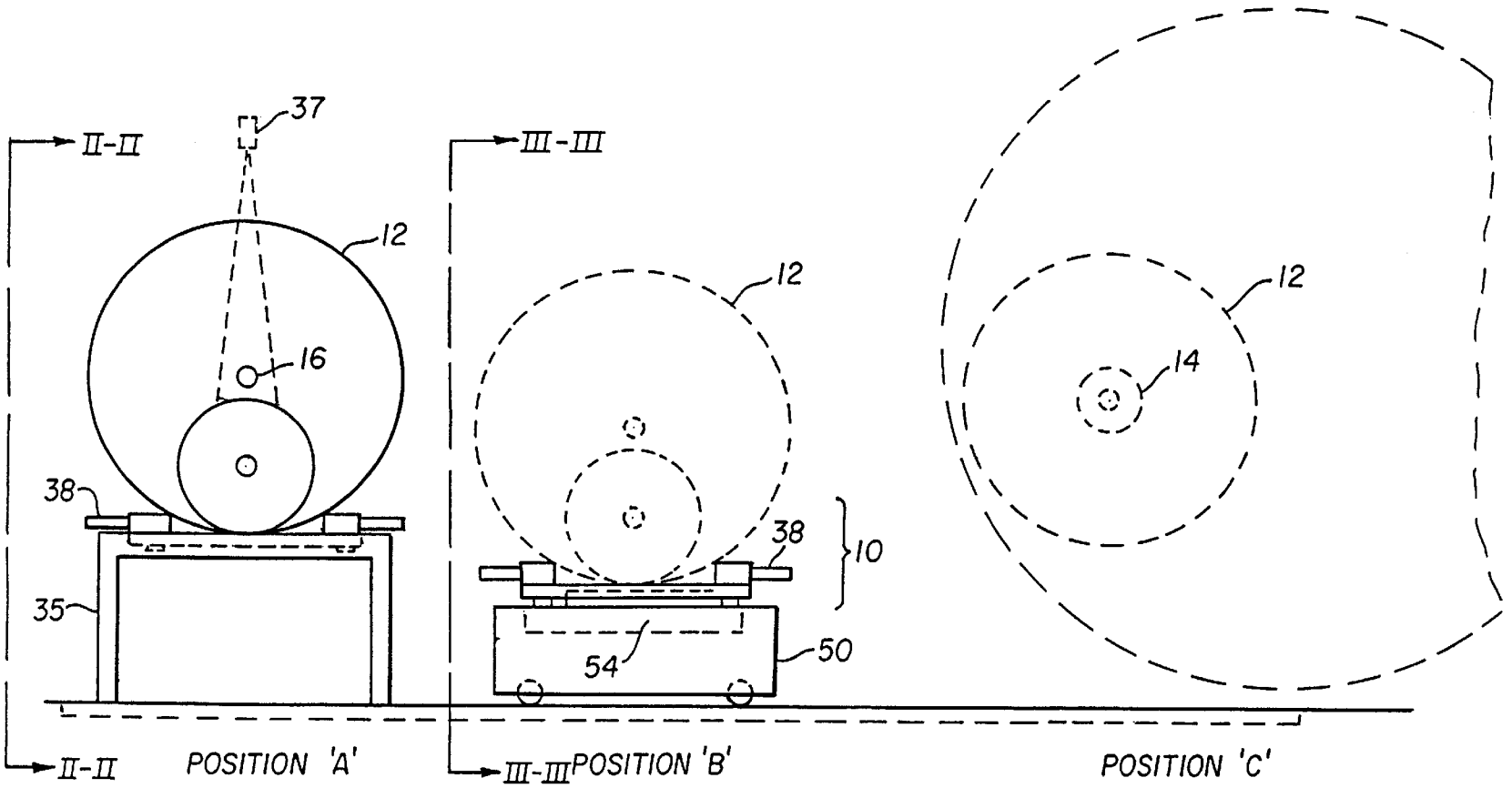
FIG. 1 is a side elevation of the invention showing the relative positions of the various elements.

Referring to FIG. 1, prior to presenting roll 12 to chucking device 14, roll 12 may be situated at rest on a first storage station 35, such as a platform. In a typical manufacturing environment, a fork lift truck (not shown) may transport the roll 12 of web arranged horizontally on a pallet 38 to the first storage station 35 for further processing. At the first storage station 35, the elevation of roll 12 is determined by a sensor 37 positioned proximate to roll 12. Once the elevation of roll 12 is determined, roll 12 is then removed from the first storage station 35 by flexible roll support members 36 (shown in FIG. 4) mounted on shuttle car 50, described below.

According to FIG. 1, shuttle car 50 is a powered, floor running, rail guided transport vehicle that operates directly underneath an elevated first storage station 35 (described above). Shuttle car 50 can then retrieve pallet 38 bearing the roll 12 from first storage station 35 and transport it to chucking device 14. Shuttle car 50 is shown midway between first storage station 35 and chucking device 14 (alternately second storage station). The shuttle car 50, generally known in the field of roll handling, is available from several sources, such as FMC Corporation, Philadelphia, Pa.

Referring again to FIG. 1, distance measuring sensor 37 is mounted over the first storage station 35 and is used with other controls to calculate the diameter of roll 12 while pallet 38 is resting on a known elevation. As the shuttle car 50 travels from the first storage station 35 (alternately referred to as a transfer stand) to the chucking position/station, lift 48 (shown in FIG. 4) raises the roll 12 up to a calculated elevation. Once the roll 12 reaches this elevation, it then remains essentially at this elevation for the duration of chucking. The chucking position/station, which is typically a winder or unwinder machine (not illustrated), is shown as Position C in FIG. 1.

In FIG. 3, more particularly, assemblage 10 for precisely aligning a roll 12 (described above) to a chucking device 14 (as described above) includes a substantially rigid frame 34 for supporting elements described below thereon. At least two substantially planar and flexibly mounted support members 36 flexibly supports pallet 38 bearing roll 12 thereon. More than two flexible support members 36 may be used with the same or similar results.

Referring again to FIG. 3, flexible support member 36 can accommodate practically any size pallet 38 and any size roll 12 of web 1. (Skilled artisans will appreciate that assemblage 10 has utility despite the diameter of the roll 12 supported on pallet 38.) To facilitate the flexible alignment of roll 12 to the chucking device 14, the nose portions 30, 32 of core engagement members 24, 26, respectively are tapered for easy penetration into core openings 18, 20 of core 16. Each flexible support member 36 has a top cover 40 and a compression head 42 biased by a plurality of springs 44 which has one end fixed against the lift platform 54. Each of the plurality of springs 44 biasing the compression head 42 is designed for partial compression as the roll 12 is lifted, so there is always free travel in upward and downward directions. A plurality of guide bolts 52 (shown in FIG. 4) are inserted through the compression head 42 and pass through spring 44 before terminating in lift platform 54 mounted to a lift 48. Compression head 42 supports a top cover 40, having a low friction material, preferably Teflon, arranged on at least a portion thereof. This low friction material which is in contact with the underside flat surface 46 of pallet 38 provides a means of facilitating sliding movements of the pallet 38 bearing the roll 12. It is important to the invention that pallet 38 bearing roll 12 is free for slidable movements on compression head 42 when one of the core openings 18, 20 is engaged by any one of the engagement members 24, 26 of chucking device 14.

Referring now to FIG. 4, flexible support members 36 are shown in more detail in their fully extended or elevated and unloaded position. Flexible support members 36 are elevated by lift platform 54 mounted to a scissor lift 48, operated by a hydraulic piston 58 for relatively smooth vertical movement. Lift 48 is fixedly mounted to shuttle car 50 (described above) that transport and elevate assemblage 10 and pallet 38 bearing roll 12.

Referring to FIG. 3, means 60, such as a motor drive, is provided for urging at least one of the core engagement members 24, 26 into engaging contact with a respective core opening 18, 20 of the core of roll 12. Force exerted by the engaging contact causes the lift platform 54 supporting pallet 38 bearing roll 12 to move freely until the first centerline 22 of the core 16 to align with the second centerline 28 of the chuck device 14. When this alignment is achieved, the roll 12 is precisely aligned with the core engagement members 24, 26 and the roll 12 can, therefore, be easily mounted thereon.

Referring to FIG. 2, in the preferred embodiment, flexible support members 36 (more clearly shown in FIG. 3) is mounted on the lift platform 54 which makes contact with the bottom, flat sliding surface 46 of pallet 38 and becomes the means to the free motion alignment. Pallet guides 64 (only one shown) may be arranged on either end of the first storage station 35 to position the pallet 38 to within the operating tolerance of the chucking device 14. With the pallet 38 positioned between the pallet guides 64, the most allowance for easier lift truck stopping tolerance is provided. The pallet 38 will be more accurately positioned relative to chucking device 14 as the lift 48 comes up so that a positioning cone 68 arranged on lift platform 54 will engage an aligned positioning cup 70 associated with pallet 38. These elements disengage as the lift 48 moves up to the chucking position/station (at Position C in FIG. 1) and the pallet 38 is restrained only at extreme limits from then on.

Referring to FIG. 3, the low friction sliding material of top cover 40 would contact the bottom, flat sliding surface 46 of pallet 38 and would restrict excessive movement of pallet 38. Stop bars 47 may also be used to keep pallet 38 from excessive movements that could shift it dangerously off center.

It should be appreciated that the movements of the roll 12 during the chucking process actually change during alignment. Because a correction in position on one end of roll 12 usually changes the position of the other end of roll 12, each end of roll 12 has to be handled separately. Thus, after one end of roll 12 is aligned with its respective core engagement member 24, 26, experience indicates that any subsequent motion of roll 12 has a very different effect because the first end aligned has become constrained and has become the pivotal point of any movement thereafter.

It should further be appreciated that assemblage 10 of the invention is also capable of removing a chucked roll 12 from the chucking position/station 30. This is essentially the reverse of the chucking process described above. In this case, lift 48 raises a pallet 38 supporting the roll 12 until a predetermined force has been reached. The lift 48 has an internal sensing device (not shown) to measure the upwardly applied force. This action places the springs 42 into the operating range of their travel. With the pallet 38 centered previously by use of the positioning cones 68 and positioning cups 70, the core engagement members 24, 26 can then withdraw, i.e., unloaded of the roll weight, while the roll 12 is then supported by the lift 18 underneath. The "float" feature of the flexible roll chuck assemblage 10 is an important feature that will eliminate high forces that would have been induced in the wound product web, or cause the roll to hang up on one of the withdrawing chucks.

The invention has therefore been described with reference to a preferred embodiment. However, it will be appreciated that variations and modifications can be effected by a person of ordinary skill in the art without departing from the scope of the invention.

What is claimed is:

1. Roll handling and transport assemblage, comprising:

means for retrieving the roll from a first roll storage and then moving said roll to a flexibly, movable roll support member, said flexible movable roll support member providing free floating alignment of said roll and comprising a plurality of spaced biased compression heads, each of said compression heads comprises a plurality of springs biased between a top cover and a frame for flexibly supporting said roll;

a first sensor for sensing the elevation of the roll on the first roll storage, said sensor producing a first signal corresponding to said elevation;

means for moving said movable roll support member to a second roll storage having a fixed centerline, said second roll storage having a preferred orientation for receiving said roll;

a second sensor for sensing said fixed centerline of said second roll storage, said second sensor generating a second signal corresponding to said fixed centerline of said second storage; and means for comparing said first signal to said second signal such that any difference between said first and second signals causes said support member to movably align relative to said fixed centerline of said second storage.

2. The assemblage recited in claim 1 wherein said top cover of each of said biased compression heads has a low friction material layer thereon.

3. The assemblage recited in claim 1 wherein said second storage has opposing engaging members arranged along the fixed centerline for supporting said roll for alignment with said roll.

4. The assemblage recited in claim 1 wherein said means for moving said movable roll support member comprises a lift platform supported for smooth vertical movements by a hydraulic piston.

5. The assemblage recited in claim 1 wherein said roll is horizontally supported for movement on a pallet, said pallet being cooperatively associated with said flexible, movable support members for aligning said roll with said second storage.

* * * * *